US009231321B2

(12) United States Patent
Nguyen

(10) Patent No.: US 9,231,321 B2
(45) Date of Patent: Jan. 5, 2016

(54) SLIM-PROFILE HARD-DISK DRIVE CONNECTOR

(71) Applicant: Apple Inc., Cupertino, CA (US)

(72) Inventor: Anthony Nguyen, San Jose, CA (US)

(73) Assignee: Apple Inc., Cupertino, CA (US)

( * ) Notice: Subject to any disclaimer, the term of this patent is extended or adjusted under 35 U.S.C. 154(b) by 68 days.

(21) Appl. No.: 13/657,187

(22) Filed: Oct. 22, 2012

(65) Prior Publication Data

US 2014/0113496 A1 Apr. 24, 2014

(51) Int. Cl.

| | |
|---|---|
| ***H01R 24/00*** | (2011.01) |
| ***H01R 12/72*** | (2011.01) |
| ***H01R 43/24*** | (2006.01) |

(52) U.S. Cl.

CPC ..... *H01R 12/724* (2013.01); *H01R 43/24* (2013.01)

(58) Field of Classification Search

USPC ..... 439/660, 495, 377, 909, 496, 262, 34; 29/825

See application file for complete search history.

(56) References Cited

U.S. PATENT DOCUMENTS

| | | | | |
|---|---|---|---|---|
| 3,193,793 | A | 7/1965 | Plunkett et al. | |
| 4,734,060 | A | 3/1988 | Kawawada et al. | |
| 4,971,565 | A | 11/1990 | Fox, Jr. | |
| 5,127,839 | A | 7/1992 | Korsunsky et al. | |
| 5,181,855 | A | 1/1993 | Mosquera et al. | |
| 5,501,612 | A | 3/1996 | Green | |
| 5,520,545 | A | 5/1996 | Sipe | |
| 5,593,311 | A | 1/1997 | Lybrand | |
| 7,104,807 | B1 | 9/2006 | Wang et al. | |
| 7,980,898 | B2 | 7/2011 | Chatterjee | |
| 8,517,773 | B2 | 8/2013 | Lee et al. | |
| 8,888,536 | B2 | 11/2014 | Degner | |
| 2012/0270448 | A1 * | 10/2012 | Tziviskos et al. | 439/660 |

* cited by examiner

*Primary Examiner* — Jean F Duverne

(74) *Attorney, Agent, or Firm* — Kilpatrick Townsend & Stockton LLP

(57) ABSTRACT

Connectors having a slim profile and that may be used for hard-disk drives and other devices. One example may provide a connector that provides a route path including a 180-degree turn while maintaining a slim profile. Another example may provide a connector having a slim profile that is easily manufactured.

21 Claims, 6 Drawing Sheets

SLIM-PROFILE HARD-DISK DRIVE CONNECTOR

BACKGROUND

The number and types of electronic devices available to consumers have increased tremendously the past few years, and this increase shows no signs of abating. Devices such as portable computers, laptops, netbooks, tablets, desktops, all-in-one computers, storage devices, portable media players, televisions and other display devices, navigation systems, monitors and other devices have become ubiquitous.

The sizes of these devices have been shrinking over the last few years. For example, many of these devices have been getting thinner. The thickness of electronic devices such as all-in-one and laptop computers has become an important marketing concern as well as a highly visible feature to consumers.

While these devices have been getting thinner, their functionality has been increasing. For example, larger memories, WiFi and cellular interface capabilities, larger batteries for longer battery life, and others, have become common features of these devices.

These electronic devices may include various electronic components such as hard-disk drives, solid-state drives, optical drives, batteries, keyboards, trackpads, display screens, and other components. These components often need to be connected to a main-logic board or other substrate. These connections may include a connector to make electrical connections to contacts connected to the electronic component. The connectors may connect these contacts to wires, flexible circuit boards, or other conductors.

In some circumstances, the conductors may be routed such that they form a U-turn or 180 angle. But wires and such conductors can only be bent in the shape of a "U" above a certain turn radius. Below this radius, the conductors may become damaged. This limitation on how small a U-turn can be made increases the thickness of the profile of the connector, which thereby increases the space consumed by such a connector. Moreover, such conductors may be more likely to encounter device enclosures or components. During device lifetime, this contact may transmit vibrations from the enclosure or components to the connector and its electronic component, thereby reducing their lifetime.

Thus, what is needed are connectors having a slim profile and that may be used for hard-disk drives and other devices.

SUMMARY

Accordingly, embodiments of the present invention may provide connectors having a slim profile and that may be used for hard-disk drives and other devices. An illustrative embodiment of the present invention may provide a connector that provides a route path including a 180-degree turn while maintaining a slim profile. Another illustrative embodiment of the present invention may provide a connector having a slim profile that is easily manufactured.

An illustrative embodiment of the present invention may provide terminals exiting a rear of a housing. The terminals may then be bent or angled to a substantially upright position to form a 90-degree angle in a clockwise direction. First ends of conductors may then be aligned in parallel with the terminals, and then attached to the terminals, for example, by soldering. The conductors thus connected may be directed downward such that this connection may form a 180-degree turn. The conductors may then be curved or bended over a first length to form a counterclockwise 90-degree angle. (One skilled in the art will understand that all angles are approximate.) The combination of the two 90-degree angles and the 180 degree angle form routing paths having a 180-degree turn. By bending the terminal in an upward direction before routing the conductors in a downward direction, the overall height or profile of the connector is reduced.

Another illustrative embodiment of the present invention may provide a connector having a slim profile that is easily manufactured. A housing having terminals exiting from a rear may be received. The terminals may be angled or bent in a 90-degree angle to an upright position. (One skilled in the art will understand that all positions are approximate.) First ends of conductors may then be attached, for example, by soldering, to the terminals. A first overmold portion may then be formed over the rear of the housing, the terminals, and the first ends of the conductors. The conductors may then be curved or bended over a first length to form another 90-degree angle. The conductors may be curved or bent using a bottom of the first overmold portion. A second overmold portion may then be formed over substantial portions of the first overmold and the first length of the conductors.

In various embodiments of the present invention, some of the conductors in the connector may be used to convey power supplies, while others may be used to convey signals. The housing may include openings to accept contacts from an electronic device, such as a hard-disk drive or other electronic device. The openings may include contacts, which have the terminals as tail portions.

Various portions of these connectors may be formed of various materials. For example, the housing and overmold portions may be formed of silicon or silicone, rubber, hard rubber, plastic, nylon, liquid-crystal polymers (LCPs), or other nonconductive material or materials. The contacts and terminals may be formed of stainless steel, copper, copper titanium, phosphor bronze, or other material. They may be plated or coated with nickel, gold, or other material.

While various embodiments of the present are well-suited as connectors for hard-disk drives, such as 2.5 or 3.5 inch Serial Advanced Technology Attachment (SATA) hard-disk drives, other embodiments of the present invention may be used as connectors for other devices, such as solid state drives, optical drives, batteries, keyboards, trackpads, display screens, and other components. These components may be employed in electronic devices such as portable computers, tablets, desktops, all-in-one computers, cell phones, smart phones, and media phones, storage devices, portable media players, navigation systems, monitors and other devices.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
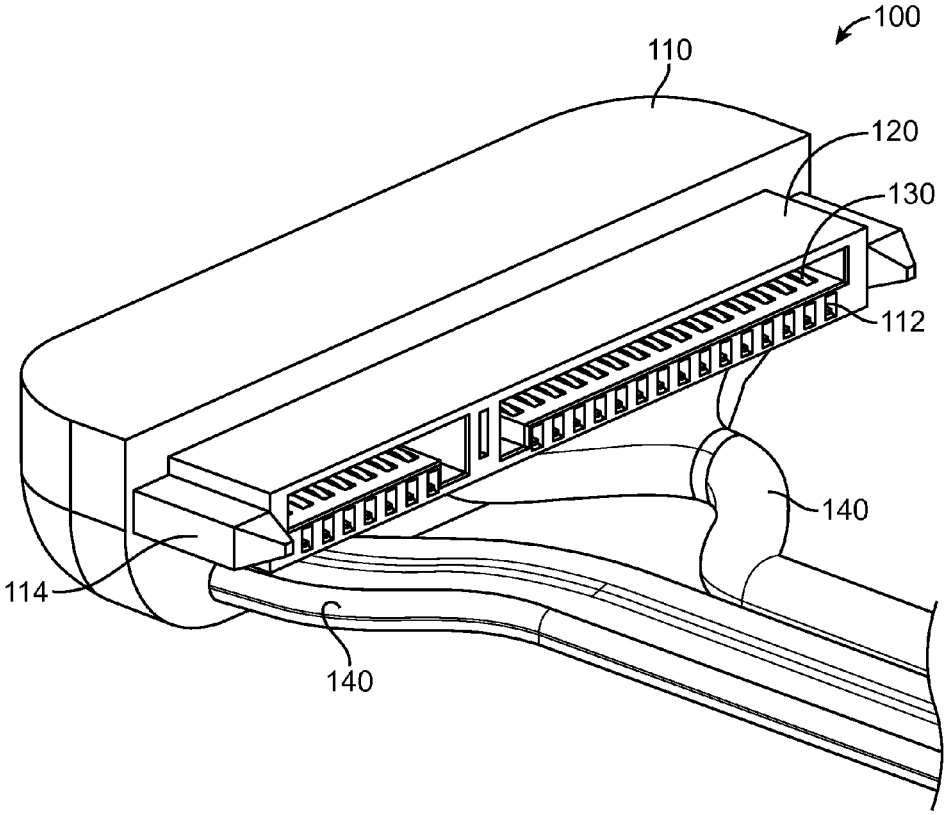
FIG. 1 illustrates a connector according to an embodiment of the present invention.

FIG. 1 illustrates a connector according to an embodiment of the present invention. Connector 100 may include housing 110 and overmold portion 120. Housing 110 may include openings 112 along a front side. Openings 112 may provide passages from contacts on an electronic component, such as a hard-disk drive or other component, which may reside in an electronic device. Contacts 130 may reside in openings 112. Conductors 140 may be routed away from connector 100. Conductors 140 may include conductors for power supplies, data signals, and other electronic information.

Housing 110 may be inserted into an opening on an electronic component. Guide posts 114 may be used during insertion to align housing 110 to the opening. Contacts emerging from the electronic component may be inserted into openings 112. The contacts on the electronic component may form electrical pathways with contacts 130, which may be in electrical contact with conductors 140.

In this example, signal paths through contacts 130 to conductors 140 may include a net 180-degree turn. This routing path may be arranged in such a way that conductors 140 emerge from connector 100 at point not far below contacts 130. This slim-profile may save space inside an electronic device housing connector 100 and the electronic component that connector 100 is connected to.

Again, with conventional connectors, conductors 140 may come into contact with a device enclosure of the electronic device or other components in the electronic device. Vibration, for example, from speakers or when the electronic device is moved, may vibrate through conductors 140 to connector 100. This may endanger connections between the connector and the electronic component in the electronic device. By providing this slim profile, conductors 140 may be routed above such enclosure or electrical component, thereby preventing this degradation due to vibration. Such an arrangement is shown in the following figure.

Figure 2:
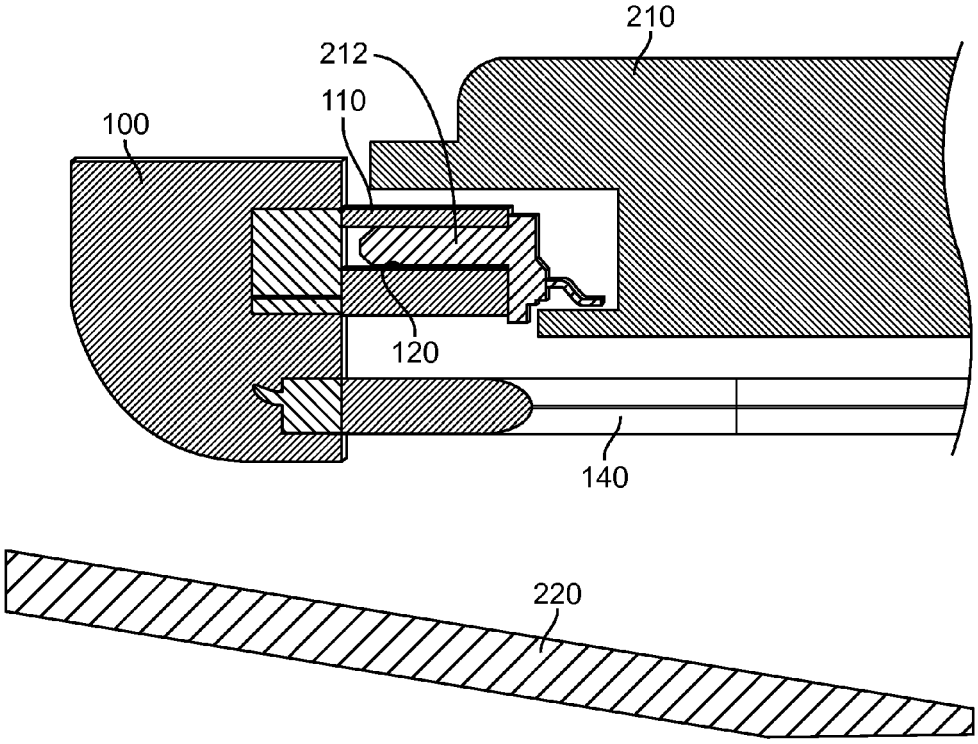
FIG. 2 illustrates the side view of a portion of a connector and an electronic device according to an embodiment of the present invention.

FIG. 2 illustrates the side view of a portion of a connector and an electronic device according to an embodiment of the present invention. Connector 100 may include housing 110 supporting contacts 120. Housing 110 may be inserted into an opening in electronic component 210. Again, electronic component 210 may be a hard-disk drive or other electronic component. Contact 212 of electronic component 210 may contact 120 of connector 100. Contact 120 may form an electrical connection inside connector 100 to conductors 140. As can be seen, conductors 140 may be located close to a bottom side of electronic component 210 away from device enclosure 220. Since conductors 140 do not contact device enclosure 220, vibrations from device enclosure 220 are not transmitted through conductors 140 and connector 100 to contacts 120 and 212.

Again, embodiments of the present invention may provide a routing path from contacts 122 conductors 140 that provides 180-degree turn. These embodiments of the present invention may do so while providing a slim profile for connector 100. Examples of how this may be done are shown in the following figure.

Figure 3:
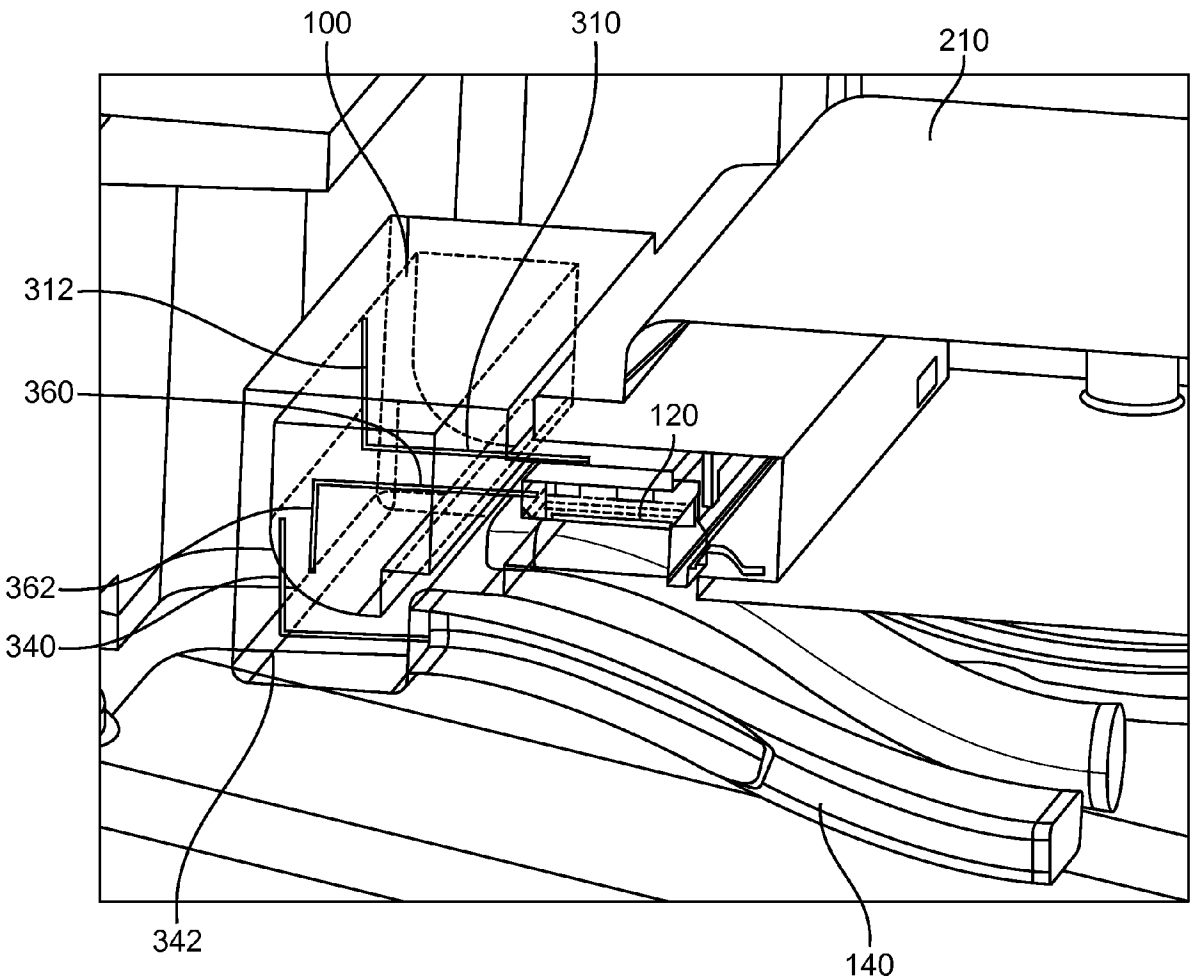
FIG. 3 illustrates a cutaway side view of a connector according to an embodiment of the present invention.

FIG. 3 illustrates a cutaway side view of a connector according to an embodiment of the present invention. Connector 100 may form electrical connections with electronic component 210. In this example, two different terminal configurations are shown. Specifically, either terminal 310 or terminal 360 may be tail portions of contacts 120. Terminals 360 may be bent to form downward portion 362. Conductors 340 may then attach to downward portions 362. Unfortunately, this places conductors 340 in a low position relative to electronic device 210, thereby necessitating be small turn radius for bend 342 and connector 340. Instead, a specific embodiment of the present invention may bend terminal 310 to have a substantially upright portion 312. This upright terminal portion 312 may then make contact with a first ends 340 of conductors 140. This higher position thus provides a greater the distance over which bend 342 may be implemented. Being able to make bend 342 over a greater length of conductors 140 protects the conductors 140 and their connection to terminal portions 312.

Figure 4:
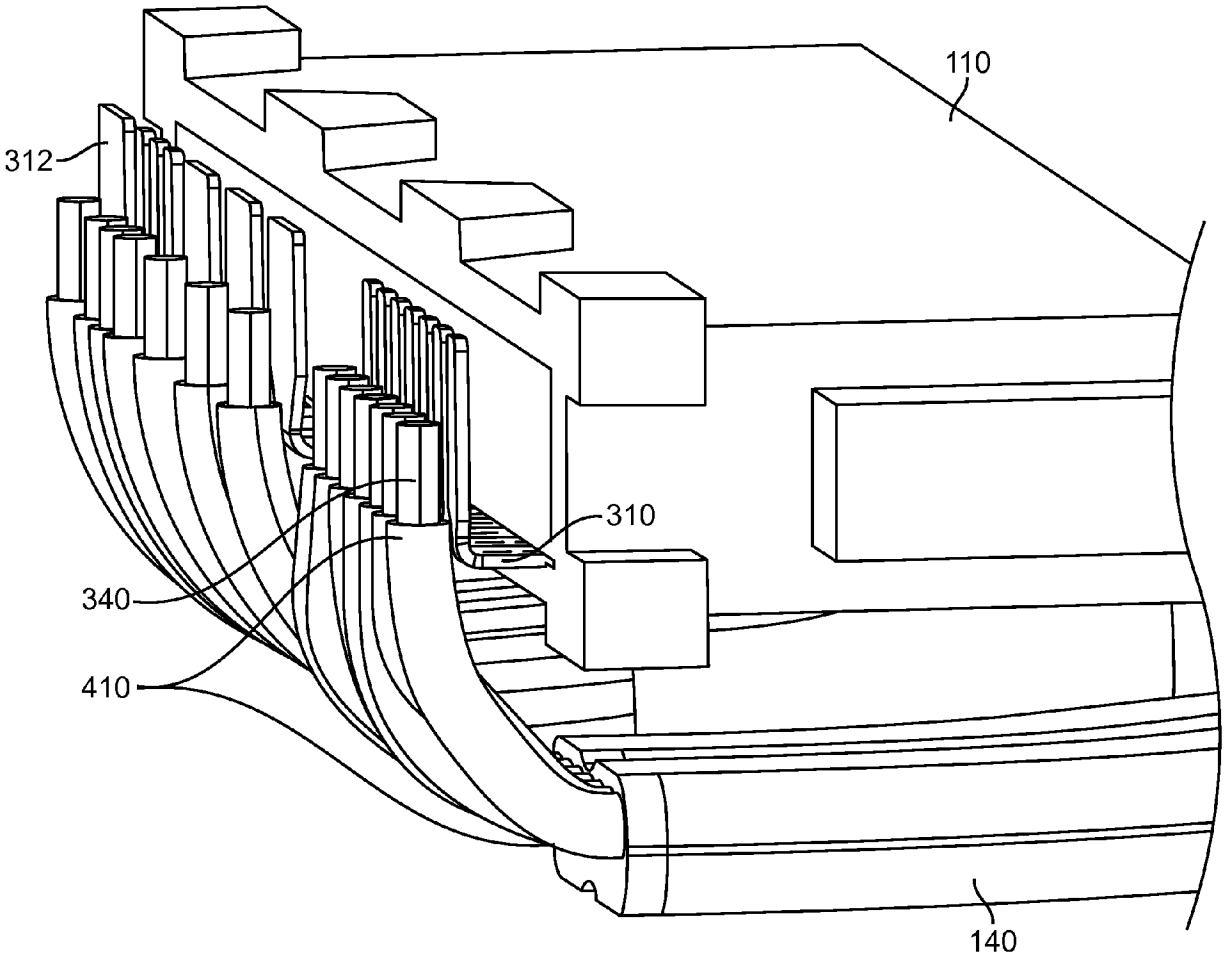
FIG. 4 illustrates a connection between first ends of conductors and terminals in a connector according to an embodiment of the present invention.

FIG. 4 illustrates a connection between first ends of conductors and terminals in a connector according to an embodiment of the present invention. Again, terminals 310 may be bent to form substantially upright portions 312. Conductors 140 may include an exposed first end 340. These exposed ends may be soldered or otherwise fixed to an upright portion 312 of terminals 310. Conductors 140 may then be bent or curved as shown.

Again, embodiments of the present invention may provide a route path providing 180-degree turn. In this example, the signal path exits housing 110 at terminal 310. Terminal 310 is bent in a clockwise direction to be substantially upright portion 312. The connection to first ends 340 of conductors 140 provides a 180-degree turn. Conductors 140 may then be bent or curved over a first length 410 to provide a counter clockwise 90-degree turn. The two 90-degree turns and 180-degree turn may result in a net 180-degree turn in the signal path between terminals 310 and conductors 140.

After connections between upper portions 312 of terminals 310 and first ends 340 of conductors 140 are formed, by soldering or otherwise, an overmold 120 may be used to protect and secure these connections. An example is shown in the following figure.

Figure 5:
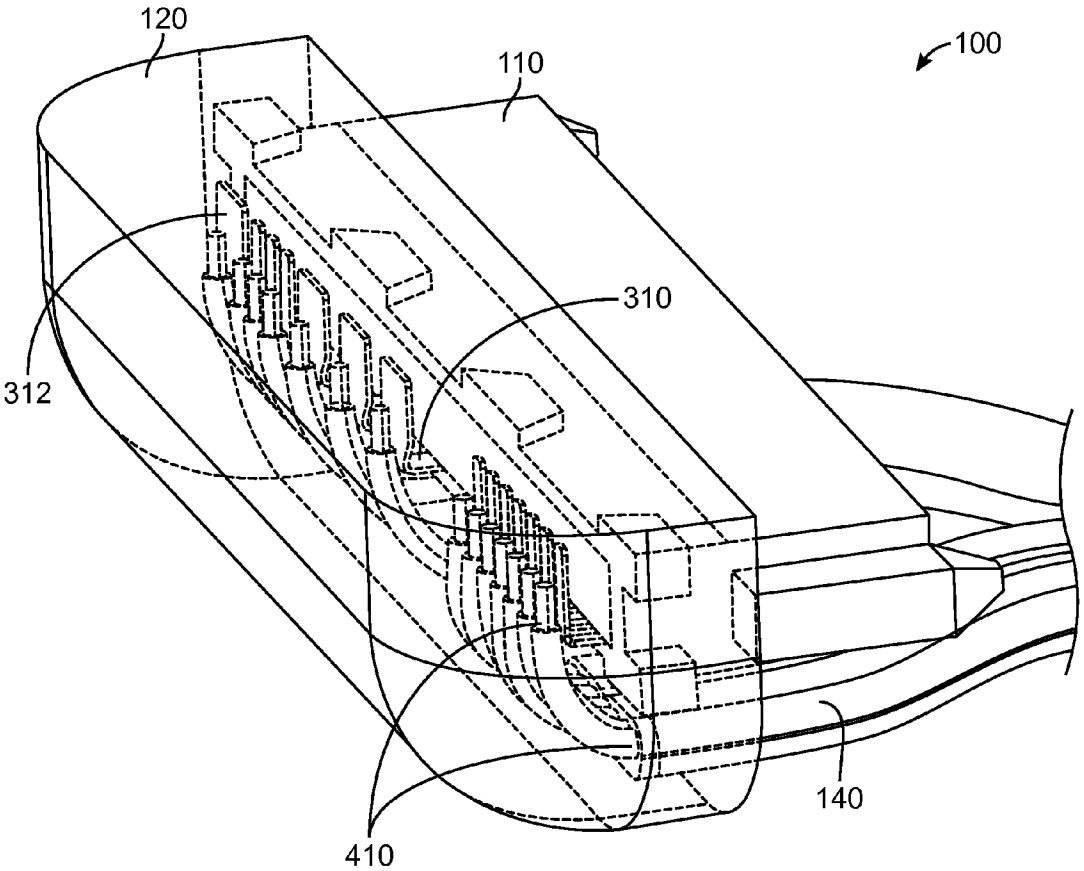
FIG. 5 illustrates portions of a connector according to an embodiment of the present invention.

FIG. 5 illustrates portions of a connector according to an embodiment of the present invention. Connector 100 may include housing 110 and overmold 120. Conductors 140 may emerge from overmold 120. Overmold 120 may cover terminals 310 and portions of conductors 140 including first ends 340 and length 410. Overmold 120 may further cover a rear portion of housing 110.

In various embodiments of the present invention, overmold 120 may be formed in various ways. In a specific embodiment of the present invention, overmold 120 may be formed using a two-step, or double shot, method. An example is shown in the following figure.

Figure 6:
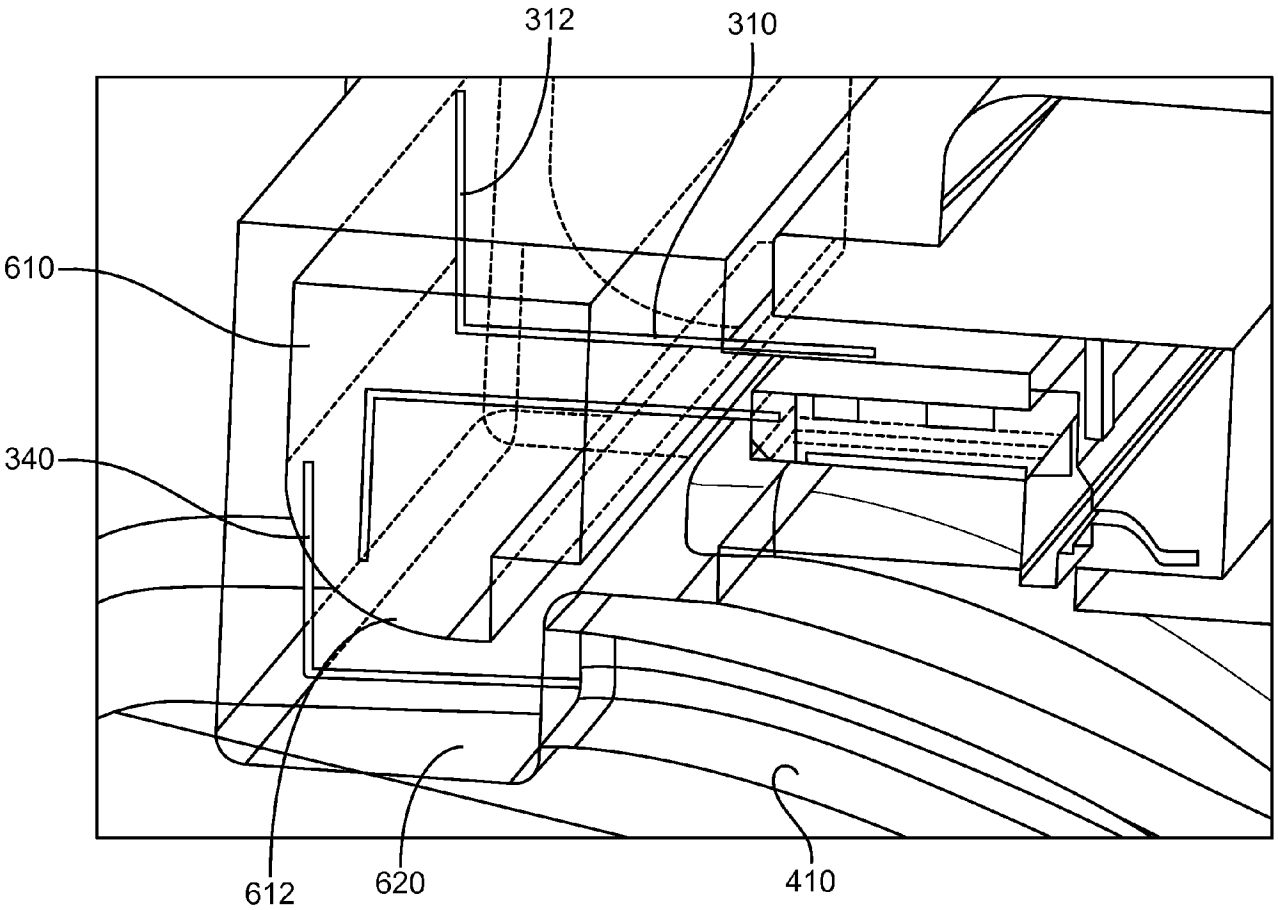
FIG. 6 illustrates a method of manufacturing and overmold according to an embodiment of present invention.

FIG. 6 illustrates a method of manufacturing an overmold according to an embodiment of the present invention. After first ends 340 of conductors 140 are attached to substantially upright portions 312 of terminals 310, a first overmold portion may be placed over these connections to protect and secure them in place. Specifically, first overmold portion 610 may cover terminals 310 and first ends 340 of conductors 140. First overmold portion 610 may include a curved bottom surface 612. This curved surface may be used to form a guide to curve conductors 140 over length 410 (not shown). A second overmold portion 620 substantially covering first overmold portion 610 and lengths 410 of conductors 140 may then be formed.

Accordingly, a connector according to an embodiment of the present invention may be formed in the following manner. A housing having terminals exiting from a rear may be received. The terminals may be angled or bent in a 90-degree angle to an upright position. First ends of conductors may then be attached, for example, by soldering, to the terminals. A first overmold portion may then be formed over the rear of the housing, the terminals, and the first ends of the conductors. The conductors may then be curved or bent over a first length to form another 90-degree angle. The conductors may be curved or bent using a bottom of the first overmold portion. A second overmold portion may then be formed over substantial portions of the first overmold and the first length of the conductors.

In various embodiments of the present invention, some of the conductors in the connector may be used to convey power supplies, while others may be used to convey signals. The housing may include openings to accept contacts from an electronic device, such as a hard-disk drive or other electronic device. The openings may include contacts, which have the terminals as tail portions.

Various portions of these connectors may be formed of various materials. For example, the housing and overmold portions may be formed of silicon or silicone, rubber, hard rubber, plastic, nylon, liquid-crystal polymers (LCPs), or other nonconductive material or combination of materials. The contacts and terminals may be formed of copper, copper titanium, phosphor bronze, or other material. They may be plated or coated with nickel, gold, or other material.

While various embodiments of the present are well-suited as connectors for hard-disk drives, such as 2.5 or 3.5 inch Serial Advanced Technology Attachment (SATA) hard-disk drives, other embodiments of the present invention may be used as connectors for other devices, such as solid state drives, optical drives, batteries, keyboards, trackpads, display screens, and other components. These components may be employed in electronic devices such as portable computers, tablets, desktops, all-in-one computers, cell phones, smart phones, and media phones, storage devices, portable media players, navigation systems, monitors and other devices.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector comprising:

a first housing having a plurality of contacts exposed at a front side for mating with corresponding contacts of an electronic component, the contacts having terminals emerging from a back side of the housing, the terminals bent approximately 90-degrees to have a substantially upright terminal portion in a substantially upright position;

a plurality of conductors formed separately from the contacts and terminals and having first ends in a substantially upright position, the first ends of the conductors contacting the substantially upright terminal portions of the contacts, the plurality of conductors extending downward away from the first ends of the conductors and then curved over a first length to form approximately a 90-degree turn; and an overmold around the terminals, the first ends of the plurality of conductors, and the first length of the plurality of conductors.

2. The connector of claim 1 wherein the connections between the plurality of terminals and conductors, and first lengths of the conductors form signals paths having approximately a 180-degree turn.

3. The connector of claim 2 wherein the terminals are bent to form approximately a 90-degree angle in a clockwise direction and the first lengths of the conductors are curved to form approximately a 90-degree angle in a counterclockwise direction.

4. The connector of claim 1 wherein the electronic component is a hard-disk drive.

5. The connector of claim 4 wherein a first subset of the plurality of conductors are a positioned to convey signals and a second subset of the plurality of conductors are positioned to convey power.

6. The connector of claim 1 wherein the first ends of the conductors are soldered to the terminals.

7. The connector of claim 1 wherein the overmold includes a first portion surrounding the rear of the housing, the terminal, and the first end of the conductor, wherein a bottom surface of the first overmold portion is used to form the bend in the first length of the conductor.

8. The connector of claim 7 wherein the overmold includes a second portion surrounding a substantial portion of the first portion and the first length of the conductor.

9. A connector having an approximate 180-degree turn in a routing path, the routing path comprising:

a terminal angled to form a clockwise angle of approximately 90 degrees;

a connection between the terminal a first end of a conductor, the conductor formed separately from the terminal, the connection between the terminal and the first end of the conductor forming an angle of approximately 180 degrees; and a bend over a first length of the conductor, the first length extending from the first end of the conductor, the bend forming a counterclockwise angle of approximately 90 degrees.

10. The connector of claim 9 wherein the terminal extends from a rear of a housing.

11. The connector of claim 10 wherein the housing includes a plurality of openings for accepting a plurality of contacts of an electronic device.

12. The connector of claim 11 wherein the rear of the housing, the terminal, the first end of the conductor, and the first length of the conductor are encased in an overmold.

13. The connector of claim 12 wherein the overmold includes a first portion surrounding the rear of the housing, the terminal, and the first end of the conductor, wherein a bottom surface of the first overmold portion is used to form the bend in the first length of the conductor.

14. The connector of claim 13 wherein the overmold includes a second portion surrounding a substantial portion of the first portion and the first length of the conductor.

15. The connector of claim 9 wherein the connector is arranged to connect to a hard-disk drive.

16. A connector comprising:

a plurality of terminals extending laterally from a housing, the plurality of terminals having ends upwardly angled to a substantially upright position such that they form an approximately 90-degree angle;

a plurality of conductors formed separately from the plurality of terminals, the plurality of conductors having first ends upwardly angled and connected to upwardly angled ends of the plurality of terminals such that the plurality of conductors are routed downward to form an approximately 180-degree angle to the upwardly angled ends of the terminals, wherein the plurality of conductors are curved over a first length extending from the first ends of the conductors such that the curve forms an angle of approximately 90-degrees; and a first overmold portion formed over a rear of the housing, the upwardly angled ends of the terminals, and the first ends of the conductors.

17. The connector of claim 16 further comprising a second overmold portion formed over a substantial part of the first portion of the overmold and the first length of the conductors.

18. The connector of claim 17 wherein the curve in a first length of the plurality of conductors is curved using a bottom of the first overmold portion.

19. The connector of claim 16 wherein the two approximately 90-degree angles and the approximately 180-degree angle are arranged to form an approximately 180-degree angle.

20. The connector of claim 16 wherein first ends of a plurality of conductors are attached to the upwardly angled ends of the plurality of terminals by soldering.

21. The connector of claim 16 wherein the connector is arranged to connect to a hard-disk drive.

* * * * *